United States Patent [19]

Lindquist et al.

[11] Patent Number: 4,773,118

[45] Date of Patent: Sep. 27, 1988

[54] NOISE REDUCTION ARRANGEMENT FOR A VACUUM CLEANER

[75] Inventors: Tommy N. Lindquist, Farsta; Milos Vukotic, Skärholmen; Ann-Christine Hedin, Danderyd; Kurt O. Francke, Huddinge; Gunnar Lundmark, Spånga, all of Sweden

[73] Assignee: Aktiebolaget Electrolux, Sweden

[21] Appl. No.: 142,122

[22] Filed: Jan. 11, 1988

[30] Foreign Application Priority Data

Feb. 2, 1987 [SE] Sweden ..... 8700390

[51] Int. Cl.[4] ..... A47L 9/00

[52] U.S. Cl. ..... 15/326; 181/229

[58] Field of Search ..... 15/326; 181/229, 231, 181/214

[56] References Cited

U.S. PATENT DOCUMENTS

| | | | |
|---|---|---|---|
| 2,881,860 | 4/1959 | Ternes | 181/229 X |
| 3,564,641 | 2/1971 | Meyer | 15/326 X |
| 3,831,223 | 8/1974 | Colt et al. | 15/326 X |
| 4,450,933 | 5/1984 | Fukuoka et al. | 181/229 |
| 4,727,651 | 3/1988 | Nakajima | 181/214 X |

FOREIGN PATENT DOCUMENTS

| | | | |
|---|---|---|---|
| 118862 | 10/1978 | Japan | 15/326 |

*Primary Examiner*—Chris K. Moore

*Attorney, Agent, or Firm*—Alfred E. Miller

[57] ABSTRACT

In a vacuum cleaner comprising a suction fan and a motor for driving the fan, a noise reduction wall construction is provided in front of and spaced from the inlet of the fan. The wall construction comprises two parallel, mutually spaced wall panels which by means of intermediate spacer means are firmly interconnected to form a rigid unit.

3 Claims, 1 Drawing Sheet

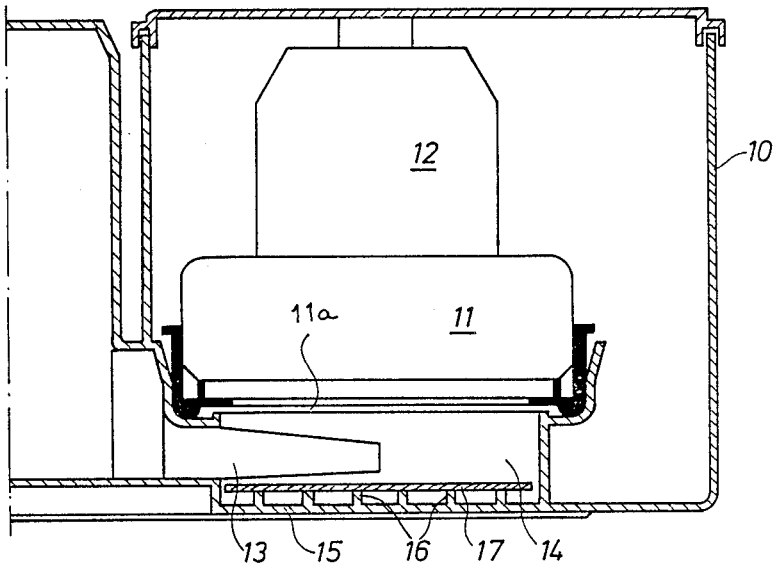
12
10
11a
11
13
15
16
17
14

NOISE REDUCTION ARRANGEMENT FOR A VACUUM CLEANER

The present invention relates to a vacuum cleaner comprising a housing in which a suction fan with its appurtenant drive motor are provided.

In recent years the power of the fan units of vacuum cleaners has increased more and more which has caused increased noise problems. At the same time the demands for low noise levels have increased. As is easily realized, it is difficult to fulfill both of these mutually connteracting objectives.

The object of the invention is to present a solution to this problem and to provide a vacuum cleaner in which the noise level has been substantially reduced. This has been obtained by means of a construction in a vacuum cleaner which according to the invention is characterized by a wall construction provided in front of and spaced from the inlet of the fan, said wall construction comprising two parallel, mutually spaced, wall panels which by means of intermediate spacer means are interconnected to form a rigid unit.

The invention will be described in more detail herinafter with reference to the accompanying drawing which the sole FIGURE illustrates a partial section of the vacuum cleaner according to the invention.

In the drawing, a portion of a vacuum cleaner housing 10 is shown in which a suction fan 11 with its appurtenant drive motor 12 is provided with its axis extending vertically. The air current to the fan 11 is conducted from a dust filter (not shown) via an inlet 13 to a chamber 14 below the inlet 11*a* of the fan.

The chamber 14 is limited in a downward direction by a wall construction comprising an outer wall panel 15 made integral with the housing 10 and provided with a plurality of spaced projections 16. An inner wall panel 17 is firmly secured to the projections 16 by for example ultrasound welding or bonding. This provides for a very rigid double wall construction with air spaces therebetween, thus having favorable silencing properties.

The described wall construction has in practice provided an essential reduction of the noise emitted by the fan.

We claim:

1. A vacuum cleaner comprising a housing, a fan-motor arrangement in said housing, a wall construction in said housing in front of but spaced from the inlet of said fan, said wall construction including two substantially parallel wall panels, and a plurality of spacer means between said panels for separating said panels in spaced relationship while rigidly interconnecting said panels to thereby reduce the noise transmission of said fan.

2. A vacuum cleaner as claimed in claim 1 wherein said spacer means are a plurality of spaced projections on one of said wall panels.

3. A vacuum cleaner as claimed in claim 1 wherein one of said wall panels is integral with said housing.

* * * * *